United States Patent [19]

Ikeda

[11] 4,233,476

[45] Nov. 11, 1980

[54] MOVING COIL TYPE CARTRIDGE

[76] Inventor: Isamu Ikeda, 3-17, Oyamadai 1-chome, Setagaya-ku, Tokyo, Japan

[21] Appl. No.: 4

[22] Filed: Jan. 2, 1979

[30] Foreign Application Priority Data

Mar. 27, 1978 [JP] Japan ..... 53-35127

[51] Int. Cl.[3] ..... H04R 9/16

[52] U.S. Cl. ..... 179/100.41 D; 179/100.41 K

[58] Field of Search ..... 179/100.41 D, 100.41 K, 179/100.41 Z; 274/37

[56] References Cited

U.S. PATENT DOCUMENTS

| | | | |
|---|---|---|---|
| 3,139,490 | 6/1964 | Lyons | 179/100.41 D |
| 3,526,728 | 9/1970 | Iga | 179/100.41 K |

FOREIGN PATENT DOCUMENTS

| | | | |
|---|---|---|---|
| 79385 | 6/1955 | Denmark | 179/100.41 Z |
| 1447982 | 12/1968 | Fed. Rep. of Germany | 179/100.41 K |
| 2365030 | 3/1975 | Fed. Rep. of Germany | 179/100.41 K |

*Primary Examiner*—Bernard Konick
*Assistant Examiner*—Donald McElheny, Jr.
*Attorney, Agent, or Firm*—Leydig, Voit, Osann, Mayer & Holt, Ltd.

[57] ABSTRACT

A moving coil type of carriage for reproduction of sound on stereo discs in which there are four substantially flat pole faces arranged in square configuration facing mutually inwardly to define a central space and forming first and second opposed pairs. Permanent magnets are provided for magnetizing the first and second pairs so that the opposed pole faces are of the same polarity and adjacent pole faces are of opposite polarity. A first coil in the central space has its axis parallel to the first pair of pole faces with the turns thereof spaced along and lying closely adjacent such pole faces. A second coil in the central space has its axis parallel to the second pair of pole faces with the turns spaced along and lying closely adjacent such pole faces, the coils being secured together to form a square prism with the axes of the coils at right angles to one another. The coils are mounted upon a shank or cantilever of non-magnetic material arranged along a central axis which is substantially perpendicular to both of the coil axes. Finally, means are provided for resiliently supporting the shank so that movements of the stylus in two directions produce axial movements in the respective coils.

3 Claims, 6 Drawing Figures

MOVING COIL TYPE CARTRIDGE

This invention relates to phonograph cartridges and, more particularly, to improvements in such cartridges of moving coil (MC) type.

DESCRIPTION OF THE PRIOR ART

For the cartridges of the kind referred to, there has been widely used, for example, the one having such structure as shown in FIGS. 1 and 2 of accompanying drawings, in which 1 is a bar shape permanent magnet having N and S poles respectively at each longitudinal end, 2 and 3 are yokes respectively secured at one end to each pole surface of the magnet 1 so as to provide a magnetic gap between respective the other ends of the yokes, 4 is a cantilever of a nonmagnetic material having a stylus at a tip end and disposed to pass through a hole made in the other end of the yoke 2 forming the magnetic gap so as to further extend through the gap to reach at tail end the other end of the yoke 3 also forming the gap, 5 is a coil, which is wound into two parts for left and right channel reproductions and respectively of a rectangular or square shape and is secured to the cantilever at a position disposed in the magnetic gap, and 6 is a damper of a resilient material fitted in a hole made in the gapforming end of the yoke 3 for resiliently supporting the tail end of the cantilever 4 so as to allow the cantilever 4 as well as the coil 5 to be rotatable about a fulcrum 6' at the root point of the cantilever supported by the damper 6.

In the above arrangement, magnetic fluxes flow through the gap in a direction $\phi$ from the yoke 2 connected to the N-pole to the yoke 3 connected to the S-pole of the magnet 1, the fulcrum 6' for the rotation of the cantilever 4 is generally located on the rearward side of the coil 5 with respect to the flux flowing direction $\phi$ and, when the tip end of the cantilever 4 is rotated with the fulcrum 6' as the center in a direction represented by an arrow R in FIG. 2, the coil 5 is also rotated within the magnetic fluxes together with the cantilever 4, whereby electromotive forces are generated in front and rear coil sections **5*f* and 5*r* of the coil 5 which are vertical to the flux flowing direction $\phi$ and thus are caused to move within the fluxes vertically to the flux flowing direction $\phi$. Since, in this case, the front coil sections 5*f* located further than the rear coil sections 5*r* from the fulcrum 6' achieve a movement of a larger stroke than that of the rear coil sections 5*r*, an electromotive force $e_F$ generated in the front coil sections 5*f* is larger than an electromotive force $e_R$ generated in the rear coil sections 5*r* and, further, since the respective coil sections 5*f* and 5*r*** move within the magnetic fluxes of the same flowing direction $\phi$, directions of the generated electromotive forces $e_F$ and $e_R$ are identical to one another so that the former will be partly cancelled by the latter. Therefore, the effective electromotive force obtained in the entire coil will be represented by the following formula, wherein "n" representing the number of coil winding:

$$n\,(e_F - e_R) \qquad (1)$$

So long as the magnetic fluxes pass through substantially the same dimensions of areas of the respective coil sections **5*f* and 5*r*, the difference between the respective electromotive forces $e_F$ and $e_R$ is small since a difference in rotating amplitude of the front coil section 5*f* from that of the rear coil section 5*r*** is practically small, and eventually the effective electromotive force generated is caused to be small. For this reason, it has been necessary for obtaining a larger effective electromotive force to generally employ a coil of such a large number of coil winding as to be at least several ten times. Even with such measure, however, the effective electromotive force that could be generated has been extremely small so as to be, for example, about 0.1 mV so that a problem of cross-talk has been readily caused to occur, and the necessity of increasing the coil winding number has been rendering another necessity of reducing the weight of the cartridge for reducing stylus stress onto record disk to be difficult or practically impossible to be satisfied.

The present invention has been suggested in view of such defects of conventional MC-type cartridges as has been described.

OBJECTS OF THE INVENTION

Primary object of the present invention is, therefore, to provide an MC-type cartridge capable of generating a larger electromotive force.

Another object of the present invention is to provide an MC-type cartridge capable of reducing the size and weight of coil.

A further object of the present invention is to provide an MC-type cartridge capable of effectively removing possible problem of cross-talk.

Other objects and advantages of the present invention shall be made clear in the following disclosure of the invention detailed with reference to a preferred embodiment shown in accompanying drawings, in which:

While the present invention shall now be explained by reference to the preferred embodiment shown, it should be noted that the intention is not to limit the invention to the particular embodiment, but is to rather include all modifications, alternations and equivalent arrangements possible within the scope of appended claims.

DESCRIPTION OF THE PREFERRED EMBODIMENT

Figure 1:
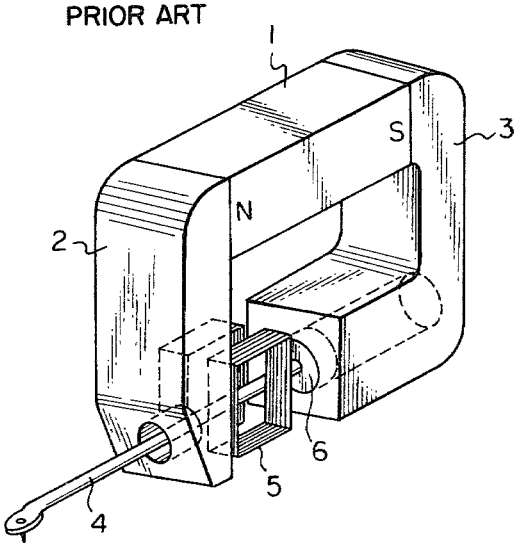
Fig. 1 PRIOR ART
FIG. 1 is a perspective view of main parts in a typical one of conventional MC-type cartridges.
Figure 2:
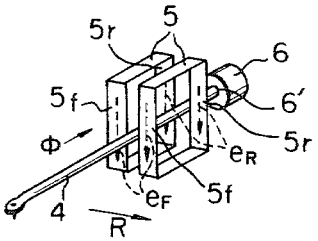
Fig. 2 PRIOR ART
FIG. 2 is a schematic perspective view for explaining the electromotive force generated in the cartridge of FIG. 1.
Figure 3:
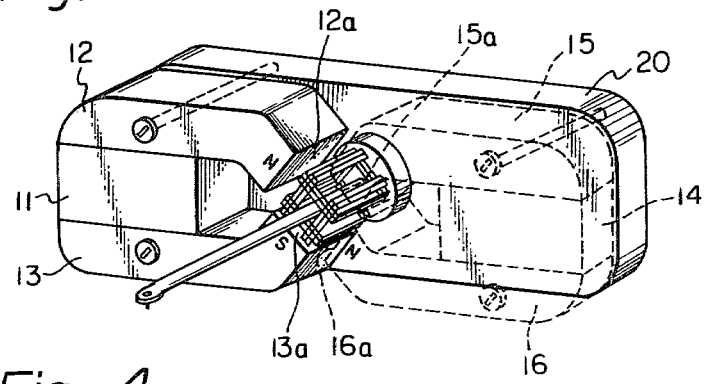
FIG. 3 is a perspective view of main parts of an embodiment according to the present invention with a part removed but shown in broken lines.
Figure 4:
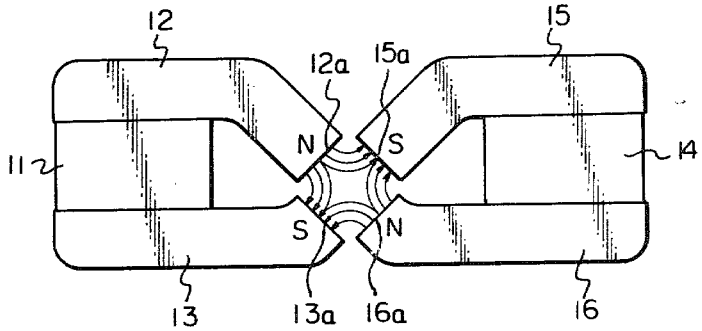
FIG. 4 is an explanatory plan view of magnetic circuits in the embodiment of FIG. 3.

Referring to FIG. 3, 11 is a permanent magnet substantially of a rectangular bar shape but polarized at opposing surfaces perpendicular to the longitudinal axis, 12 and 13 are yokes respectively of a bar shape bent at one end and butted at substantial straight body to each of the polarized surfaces of the magnet 11 so that their bent ends will extend convergently from the magnet to approach one another, and respective end surfaces 12*a* and 13*a* of these yokes are disposed to mutually define an angle of 90° in the present instance and are magnetized so that, in the present instance, the end surface 12*a* of the yoke 12 is magnetized to be N-pole and the other end surface 13*a* of the yoke 13 is of S-pole. Another permanent magnet 14 shown in broken lines is of the same shape, dimensions and polarization as those of the magnet 11, and yokes 15 and 16 also shown in broken lines and of the same shape and dimensions as those of the yokes 12 and 13 are coupled to the magnet 14 in the same manner as in the case of the yokes 12 and 13. Therefore, respective end surfaces 15*a* and 16*a* of these yokes 15 and 16 are also disposed to mutually define the angle of 90° and to be respectively in the relation of being perpendicular to the respective end surfaces 12*a* and 13*a* of the yokes 12 and 13, while the respective yoke ends are spaced from each other at equal intervals. Further, the end surface 15*a* of the yoke 15 disposed adjacent the N-pole end surface 12*a* of the yoke 12 is magnetized to be of the opposite polarity, that is, to be S-pole in the present instance, whereas the end surface 16*a* of the yoke 16 disposed adjacent the S-pole end surface 13*a* of the yoke 13 is magnetized to be N-pole in the present instance. Accordingly, the permanent magnets 11 and 14 and yokes 12, 13, 15 and 16 form a pair of magnetic circuits including a single magnetic field space which is square shape in the present instance as seen in the direction of the center axis of the space, as shown in FIG. 4, in which respective magnetic fluxes of each magnetic circuit are influencing on each other. In other words, each of the yoke ends forming the magnetic field space is magnetized to be of the opposite polarity with respect to adjacent ones so that they will be alternately of the N-pole, S-pole, N-pole and S-pole, and the magnetic fluxes flowing out of the respective N-poles of the yokes 12 and 16 are biased as divided into two flux packages toward the adjacent two S-poles of the yokes 13 and 15 have adjacent edges slightly spaced from one another at an equal distance, as shown whereby four magnetic gaps through which the magnetic fluxes are flowing are formed at each of corners in the magnetic field space, in the present embodiment. It will be appreciated that, in each of the magnetic gaps, the direction in which the fluxes flow is opposite to that in adjacent gaps. It will further be seen (e.g., in FIG. 4) that the lines of flux flowing through the pole faces from one pole face to the next are generally perpendicular to the face.

Figure 5:
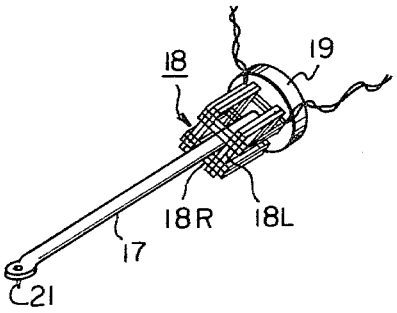
FIG. 5 is a perspective view of a cantilever and coil assembly employed in the embodiment of FIG. 3.

In FIG. 5, there is shown a structure of cantilever and coil structure employed in the cartridge according to the present invention, in which 17 is a cantilever or shank of nonmagnetic material provided with a stylus 21 secured at a tip end and with coils 18 fixed around the cantilever adjacent the other end. In the coils 18, there is employed no bobbin. That is, in winding the coil wires into the coils, a pair of plate members of an easily breakable or removable material are initially fitted at their centers to the cantilever in vertical relation thereto and as spaced from one another, coil wires are wound between the spaced plate members so as to substantially extend, in the present instance, in parallel to the cantilever as will be described in the followings, thus wound coils are provisionally fixed to the cantilever by means of a binding agent, the plate members only are then removed, and thereafter the coils remained on the cantilever are completely secured thereto by the binding agent.

Figure 6:
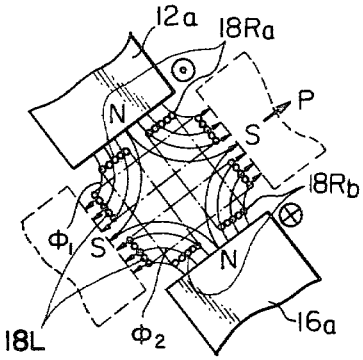
FIG. 6 is a fragmental explanatory view of magnetic gaps with the coil schematically shown in section of the embodiment of FIG. 3 for explaining the operation of the same.

The coils 18 comprise, in the present case, a pair of coil parts 18R for right channel reproduction and a pair of coil parts 18L for left channel reproduction, each of which coil parts 18R and 18L is wound in a rectangular shape that includes sections parallel to the longitudinal axis of the cantilever 17 and sections perpendicular to the axis. In this embodiment, further, the respective coil sections in each of the coil parts 18R and 18L are coupled to cross each other at their parts adjacent their ends of the sections perpendicular to the cantilever axis so that the coils will form substantially a square prism, or cubical, shape as a whole and the cantilever 17 passes through the longitudinal axis of such prism shape. As shown in FIG. 6, the first coil 18R has turns spaced along and lying closely adjacent the "N" pole faces while the second coil 18L, which is at right angles thereto, has turns spaced along and lying closely adjacent the "S" pole faces.

The cantilever and coil assembly thus assembled is disposed so that the cantilever axis will align with the center axis of the before described magnetic field space and the respective coil sections parallel to the cantilever axis will be parallel to the respective pole end surfaces 12*a*, 13*a*, 15*a* and 16*a* in the still state of the cantilever and also will be positioned in the magnetic gaps between the adjacent pole end surfaces.

A damper 19 supports resiliently the other end of the cantilever 17 adjacent which the coils 18 are secured, and this supporting damper 19 is mounted to a base member 20 of a nonmagnetic material to which the magnetic circuits of the magnet 11 and yokes 12 and 13 as well as the magnet 14 and yokes 15 and 16 are secured, so as to achieve the above described arrangements of the circuits and assembly, as seen in FIG. 3.

References to the operation of the cartridge having the above structure shall now be made with reference to FIG. 6, in which relations of the respective coil sections parallel to the cantilever axis to the magnetic fluxes in the magnetic field space are shown. Referring here to the coil part 18R, it will be seen that the respective "parallel" coil sections 18Ra and 18Rb of the part 18R are connected to each other in series and the respective magnetic fluxes $\phi_1$ and $\phi_2$ flowing out of the N-pole yoke end surfaces 12*a* and 16*a*, thus in directions opposite to each other, are passing through the coil sections 18Ra and 18Rb and then biased toward the both side S-pole yoke end surfaces 13*a* and 15*a* as laterally divided.

Now, provided the coils are caused to move in a direction indicated by an arrow P in FIG. 6 under the above conditions, the respective coil sections 18Ra and 18Rb transverse the fluxes $\phi_1$ and $\phi_2$ of opposite directions, so that an electromotive force $e_{Ra}$ which is in the direction coming out of the drawing as represented by a dot will be generated in the coil section 18Ra whereas an electromotive force $e_{Rb}$ which is in the direction going into the drawing as represented therein by a cross. Since these electromotive forces $e_{Ra}$ and $e_{Rb}$ generated in the coil sections 18Ra and 18Rb are thus of the opposite directions, the effective electromotive force generated in the coil part 18R will be represented by the following formula, wherein "n" being the number of coil winding:

$$n\,(e_{Ra}+e_{Rb}) \qquad (2)$$

That is, the effective electromagnetic force will be the sum of the respective electromotive forces generated in the entire "parallel" coil sections that transversely move in the fluxes. Thus, comparing the formulas (1) and (2), it will be readily understood that the effective electromotive force generated according to the present invention is remarkably larger than that obtainable with the conventional cartridge. Accordingly, it is possible to obtain an effective electromotive force of a sufficient value with a coil of which winding number is made remarkably less than in the case of conventional structure.

In the above embodiment, there has been shown the magnetic field space formed with a pair of magnetic circuits providing the four alternately oppositely polarized yoke ends which are arranged radially as spaced equally from each other. However, the structure is not to be limited to the use of the four yoke ends but may be of six or eight yoke ends or even more, as long as the radially arranged yoke ends are polarized to be opposite to adjacent ones so as to provide between each N-pole yoke end and adjacent S-pole yoke ends the magnetic gaps in which the laterally biased magnetic fluxes of opposite directions are caused to occur and the respective coil sections series connected of the coil or coils and effective to generate therein the electromotive forces are disposed in each of such laterally biased and opposite directional magnetic fluxes.

For the shape of the coil, it is also possible to wind the coil wire into such different shape from the one disclosed and shown as, for example, a cylindrical shape of which the longitudinal axis is aligned with that of the cantilever. In this case, it is preferable to wind the coil wire along the longitudinal direction of the cylindrical shape so that the coil wire extends substantially in parallel to the yoke end surfaces as in the case of the described embodiment, or it is even possible to wind the coil wire along the peripheral surface of the cylindrical shape so that the coil will extend spirally around the cantilever with a slight angle with respect to directions perpendicular to the axis of the cantilever.

According to the present invention, as described in the foregoings, the MC-type cartridge is of an arrangement wherein the magnetic fluxes from the respective N-pole yoke ends are rendered to be biased so as to be divided into two flux packages flowing in opposite directions laterally towards the adjacent both side S-pole yoke ends and the series connected coil sections effective to generate therein the electromotive forces are respectively disposed in each of such opposite directional flux packages, whereby there are shown such effects that:

The electromotive forces generated in the respective series connected coil sections are of opposite directions so that the forces will be superposed on one another, whereby the effective electromotive force obtained in the entire coil can be made extremely large.

Accordingly, a remarkably larger effective electromotive force can be generated even with a coil of a smaller number of coil winding, so that the entire coil can be made to be of a remarkably smaller weight, as compared with conventional MC-type cartridges.

Yet, as the remarkably larger effective electromotive forces can be obtained with respect to the right and left channel reproductions in the stereo phonographs, the problem of cross-talk can be effectively removed.

Referring back to the magnetic circuit structure as shown specifically in FIG. 4 of the embodiment of the present invention, the arrangement of the respective polarized yoke ends forming the magnetic field space is made offset with respect to the longitudinal axes of the permanent magnets 11 and 14 symmetrically aligned with each other by rendering one of the bent yoke ends in each magnetic circuit shorter than the other. This is advantageous to allow the central position of the cantilever and coil assembly in the magnetic field space to be similarly offset in a direction which the stylus 21 of the cantilever 17 points, whereby the stylus is made easy to achieve its access to the groove on the record disk.

What is claimed is:

1. In a moving coil type of cartridge for reproduction of sound on stereo discs in which the groove undulates in two lateral directions, the combination comprising a base member, magnetic means on the base member defining four substantially flat pole faces arranged in square configuration facing mutually inwardly to define a central space and with their adjacent edges slightly spaced from one another, the pole faces comprising first and second opposed pairs, means including permanent magnets for magnetizing the first and second pairs of pole faces so that the opposed pole faces are of the same polarity and so that adjacent pole faces are of opposite polarity with the lines of flux flowing through the pole faces from one pole face to the next being generally perpendicular to the face, a first coil in the central space having its axis parallel to the first pair of pole faces and having the turns thereof spaced along and lying closely adjacent such pole faces for acting upon by the flux flowing therethrough, a second coil in the central space having its axis parallel to the second pair of pole faces and having the turns thereof spaced along and lying closely adjacent such pole faces for acting upon by the flux flowing therethrough, the axes of the coils being at right angles to one another and the coils being physically coupled so that they together substantially form a square prism, a shank of non-magnetic material arranged along a central axis which is substantially perpendicular to both of the coil axes, the coils being secured to the shank, a stylus at the end of the shank for engaging the groove in the disc, and means for resiliently supporting the shank on the base member so that movements of the stylus in the two lateral directions cause axial movements of the coils in respective directions for cutting of the lines of flux at the respective pairs of pole pieces with the result that the coils produce respective output voltage waves representative of the undulations of the groove.

2. The combination as claimed in claim 1 in which the shank extends from the stylus through and beyond the two coils to a resilient support on the base member, the resilient support being formed of resilient damping material and the shank being supported cantilever fashion therefrom, each coil being formed in two axiallyspaced series-connected sections to accommodate the shank therebetween, the coils being fitted one inside of the other so that they together form a rigid box-like structure.

3. The combination as claimed in claim 1 in which adjacent pole faces are formed on the ends of convergent magnetic yoke pieces, a permanent magnet being interposed between the yoke pieces and in intimate engagement therewith for oppositely polarizing the adjacent pole faces.

* * * * *

UNITED STATES PATENT OFFICE

CERTIFICATE OF CORRECTION

Patent No. 4,233,476 Dated November 11, 1980

Inventor(s) Isamu Ikeda

It is certified that error appears in the above-identified patent and that said Letters Patent are hereby corrected as shown below:

On the cover page in the Abstract column:

In line 1, delete "carriage" and substitute therefor --cartridge--.

Signed and Sealed this

Third Day of March 1981

[SEAL]

Attest:

RENE D. TEGTMEYER

Attesting Officer

Acting Commissioner of Patents and Trademarks